US010503089B2

(12) United States Patent
Masuda et al.

(10) Patent No.: US 10,503,089 B2
(45) Date of Patent: Dec. 10, 2019

(54) TONER FOR DEVELOPING ELECTROSTATIC IMAGES

(71) Applicants: ZEON CORPORATION, Tokyo (JP); NOF CORPORATION, Tokyo (JP)

(72) Inventors: Azusa Masuda, Tokyo (JP); Ryuji Ohta, Tokyo (JP); Munehiro Yamada, Amagasaki (JP); Norifumi Itako, Amagasaki (JP); Ryosuke Uemura, Amagasaki (JP)

(73) Assignees: ZEON CORPORATION, Tokyo (JP); NOF CORPORATION, Tokyo (JP)

( * ) Notice: Subject to any disclaimer, the term of this patent is extended or adjusted under 35 U.S.C. 154(b) by 0 days.

(21) Appl. No.: 14/779,367

(22) PCT Filed: Mar. 26, 2014

(86) PCT No.: PCT/JP2014/058695
§ 371 (c)(1),
(2) Date: Sep. 23, 2015

(87) PCT Pub. No.: WO2014/157424
PCT Pub. Date: Oct. 2, 2014

(65) Prior Publication Data

US 2016/0048090 A1 Feb. 18, 2016

(30) Foreign Application Priority Data

Mar. 27, 2013 (JP) ..... 2013-066398

(51) Int. Cl.
*G03G 9/087* (2006.01)
*G03G 9/097* (2006.01)
*G03G 9/08* (2006.01)
*G03G 9/09* (2006.01)

(52) U.S. Cl.
CPC ..... *G03G 9/08711* (2013.01); *G03G 9/081* (2013.01); *G03G 9/08782* (2013.01); *G03G 9/08793* (2013.01); *G03G 9/08795* (2013.01); *G03G 9/08797* (2013.01); *G03G 9/0904* (2013.01); *G03G 9/09733* (2013.01)

(58) Field of Classification Search
CPC ..... G03G 9/08711; G03G 9/08795; G03G 9/081; G03G 9/09733; G03G 9/0904; G03G 9/08797; G03G 9/08793; G03G 9/08782
See application file for complete search history.

(56) References Cited

U.S. PATENT DOCUMENTS

| | | | | |
|---|---|---|---|---|
| 5,635,325 | A | 6/1997 | Inaba et al. | |
| 5,679,490 | A * | 10/1997 | Yachi | G03G 9/0806 430/108.4 |
| 2005/0277043 | A1* | 12/2005 | Tanma | G03G 9/08706 430/109.3 |
| 2007/0031748 | A1* | 2/2007 | Kotsugai | G03G 9/0806 430/108.7 |
| 2007/0178397 | A1 | 8/2007 | Yamanouchi et al. | |
| 2013/0171552 | A1 | 7/2013 | Yoshizaki et al. | |

FOREIGN PATENT DOCUMENTS

| | | | |
|---|---|---|---|
| JP | 8-50368 | A | 2/1996 |
| JP | 2007-206179 | A | 8/2007 |
| JP | 2011-138120 | A | 7/2011 |
| JP | 2012-018249 | A | 1/2012 |
| JP | 2012-078809 | A | 4/2012 |

OTHER PUBLICATIONS

International Search Report dated Jul. 1, 2014, issued in counterpart Application No. PCT/JP2014/058695 (2 pages).
Notification of Transmittal of Translation of the International Preliminary Report on Patentability (Form PCT/IB/338) issued in counterpart International Application No. PCT/JP2014/058695 dated Oct. 8, 2015, with Forms PCT/IB/373 and PCT/ISA/237 (5 pages).
Extended (supplementary) European Search Report dated Jan. 26, 2017, issued in counterpart European Application No. 14773117.8. (5 pages).

* cited by examiner

*Primary Examiner* — Thorl Chea
(74) *Attorney, Agent, or Firm* — Westerman, Hattori, Daniels & Adrian, LLP

(57) ABSTRACT

There is provided a toner for developing electrostatic images, including an external additive and colored resin particles containing a binder resin, a colorant and softening agents. The colored resin particles contain a monoester compound A represented by formula (1) and a monoester compound B represented by formula (2) as softening agents. A content of the monoester compound A is in the range from 95 to 99% by mass, a content of the monoester compound B is in the range from 1 to 5% by mass, and a content of the softening agents is in the range from 10 to 30 parts by mass, with respect to 100 parts by mass of the binder resin. Formula (1) is $R^1$—COO—$R^2$. Formula (2) is $R^3$—COO—$R^4$.

5 Claims, No Drawings

TONER FOR DEVELOPING ELECTROSTATIC IMAGES

TECHNICAL FIELD

The present invention relates to a toner for developing electrostatic images which can be used for the development of image forming devices utilizing electrophotography such as copying machines, facsimile machines and printers.

BACKGROUND ART

Conventionally, an electric latent image or a magnetic latent image is visualized by a toner in an electrophotographic device, an electrostatic recording device and the like. For example, in electrophotography, an electrostatic image (latent image) is formed on a photosensitive member, and a latent image is developed with a toner, whereby a toner image is formed. The toner image is generally transferred to a recording medium such as paper, and then fixed by a method such as heating. The toner used for developing electrostatic images is generally colored resin particles containing a colorant, a charge controlling agent and other additives in a binder resin.

As a fixing system in a dry developing system, a thermal heat roller system is widely and generally used for its fine energy efficiency. Furthermore, low-temperature fixing of toners has been demanded in recent years so as to lower the heat energy provided to toners during fixing for energy saving. It is considered that an essential technical matter to be achieved for attaining this demand is to lower the melting initiation temperature of a toner to thereby lower the fixing temperature.

Furthermore, since the improvement of fixing devices has been further improved, heat energy efficiency can be increased by decreasing the thickness of a roller on a side that is to be brought into contact with a toner image, and thus it is possible to significantly shorten a start-up time. However, since the specific heat capacity has been decreased, the difference in temperature between a part where a recording medium has passed and a part where a recording medium has not passed increases, and thus the adhesion of a toner to a fixing roller occurs. Therefore, a so-called hot offset phenomenon occurs, in which a toner is fixed on a non-image part on a recording medium after one rotation of a fixing roller. Therefore, the demands for the hot offset resistance together with the low-temperature fixability of toners have become stricter.

It is essential to incorporate a release agent (a softening agent) in a toner so as to improve the hot offset resistance of the toner, and properties such as low melting viscosity and excellent separability from resins are desired for such release agent. Generally, as release agents used for toners, for example, hydrocarbon-based waxes as represented by carnauba wax, polyethylene, polypropylene, paraffin and the like are known.

Meanwhile, a toner using a synthetic ester wax as a release agent has also been suggested. For example, Patent Literature 1 discloses a toner for developing electrostatic images containing at least a binder resin, a colorant and an ester wax, wherein the toner contains a specific amount of a specific ester wax, and also discloses that the transparency of a fixed image on an OHP film is improved, and that the toner is excellent in fixability and offset resistance. Patent Literature 2 discloses a toner containing a binder resin, a colorant and a release agent, wherein the release agent contains a monoester compound and hydrocarbon compound having specific structures, and also discloses that the toner can be fixed at a low temperature and does not cause band-like or string-like image defects in a fixed image.

Patent Literature 3 discloses a toner containing a release agent, a binder resin and a colorant, wherein the release agent has a kinetic viscosity, a melting point and the like within specific ranges, and also discloses that the toner is excellent in low-temperature fixability and fouling resistance. Patent Literature 4 discloses a toner having toner particles containing a binder resin, an ester wax and a colorant, which has components as detected at a specific time measured by a GC/MS analysis of the ester wax within specific ranges, and also discloses that the toner shows a fine fixing property even in high-speed image formation, suppresses machine fouling, and can provide an image without gloss unevenness for a long period. Patent Literature 5 discloses a toner produced by emulsifying or dispersing a liquid in which a toner material containing a binder resin and a release agent is dissolved or dispersed in an organic solvent, in an aqueous medium, wherein a mixture containing a synthetic ester wax formed of a monoester having a specific melting point and an erythritol wax having a branched structure, and a hydrocarbon wax having a specific melting point at a specific ratio is used as the release agent, and also discloses that the toner is excellent in release property and low-temperature fixability, and has low fouling property.

However, in accordance with the demands for energy saving in recent years, there were some cases when the balance of lowering a fixing temperature and heat-resistant shelf stability was insufficient in the toners obtained by the methods of above-mentioned patent literatures.

CITATION LIST

Patent Literature 1: Japanese Patent Application Laid-Open (JP-A) No. H8-50368
Patent Literature 2: JP-A No. 2007-206179
Patent Literature 3: JP-A No. 2011-138120
Patent Literature 4: JP-A No. 2012-78809
Patent Literature 5: JP-A No. 2012-18249

SUMMARY OF INVENTION

Technical Problem

An object of the present invention is to provide a toner that exhibits an excellent balance between heat-resistant shelf stability and low-temperature fixability, and exhibits an excellent hot offset resistance.

Solution to Problem

As a result of diligent researches to solve the above problems, the inventors of the present invention have found out that the above problems can be solved by incorporating a specific amount of a mixture of at least two kinds of monoester compounds having specific structures as softening agents in colored resin particles that constitute a toner for developing electrostatic images.

That is, the present invention provides a toner for developing electrostatic images, comprising an external additive and colored resin particles containing a binder resin, a colorant and softening agents, wherein the colored resin particles contain a monoester compound A represented by the following formula (1) and a monoester compound B represented by the following formula (2) as the softening agents, and a content of the monoester compound A is in the range from 95 to 99% by mass, and a content of the monoester compound B is in the range from 1 to 5% by mass, and wherein a content of the softening agents is in the range from 10 to 30 parts by mass, with respect to 100 parts by mass of the binder resin:

$R^1$—COO—$R^2$ Formula (1):

wherein, $R^1$ is a linear alkyl group having 17 to 23 carbons; $R^2$ is a linear alkyl group having 16 to 22 carbons; and a sum of the carbons of $R^1$ and $R^2$ is 39;

$R^3$—COO—$R^4$ Formula (2):

wherein, $R^3$ is a linear alkyl group having 15 to 21 carbons; $R^4$ is a linear alkyl group having 16 to 22 carbons; and a sum of the carbons of $R^3$ and $R^4$ is 35 to 37.

In the present invention, it is preferable that the softening agents have a melting point of from 60 to 75° C.

In the present invention, it is preferable that the softening agents have an acid value of 1.0 mgKOH/g or less and a hydroxyl value of 10 mgKOH/g or less.

Advantageous Effects of Invention

According to the above-mentioned toner for developing electrostatic images of the present invention, the toner that is excellent in balance between heat-resistant shelf stability and low-temperature fixability and is also excellent in hot offset resistance is provided by incorporating, as softening agents, the monoester compound A having the structure of the above-mentioned formula (1) and the monoester compound B having the structure of the above-mentioned formula (2) at respective specific ratios, and incorporating the softening agents at a specific ratio with respect to 100 parts by mass of a binder resin.

DESCRIPTION OF EMBODIMENTS

The toner for developing electrostatic images of the present invention is a toner for developing electrostatic images, including an external additive and colored resin particles containing a binder resin, a colorant and softening agents, wherein the colored resin particles contain a monoester compound A represented by the following formula (1) and a monoester compound B represented by the following formula (2) as the softening agents, and a content of the monoester compound A is in the range from 95 to 99% by mass, and a content of the monoester compound B is in the range from 1 to 5% by mass, and wherein a content of the softening agents is in the range from 10 to 30 parts by mass, with respect to 100 parts by mass of the binder resin:

$R^1$—COO—$R^2$ Formula (1):

wherein, $R^1$ is a linear alkyl group having 17 to 23 carbons; $R^2$ is a linear alkyl group having 16 to 22 carbons; and a sum of the carbons of $R^1$ and $R^2$ is 39;

$R^3$—COO—$R^4$ Formula (2):

wherein, $R^3$ is a linear alkyl group having 15 to 21 carbons; $R^4$ is a linear alkyl group having 16 to 22 carbons; and a sum of the carbons of $R^3$ and $R^4$ is 35 to 37.

Hereinafter, the toner for developing electrostatic images (hereinafter may be referred to as "toner") of the present invention will be described.

The toner of the present invention contains a binder resin, a colorant, specific softening agents and an external additive.

Hereinafter, a method for producing the colored resin particles used in the present invention, the colored resin particles obtained by the production method, a method for producing the toner of the present invention using the colored resin particles and the toner of the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, softening agents, and other additives such as a charge control agent, etc., which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use macromonomer as part of the polymerizable monomer since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular weight of 1,000 to 30,000. A preferable macromonomer is one capable of providing a polymer having higher glass transition temperature (hereinafter may be referred to as "Tg") than a polymer obtained by the polymerization of the monovinyl monomer. The macromonomer to be used is preferably in the range from 0.03 to 5 parts by mass, more preferably from 0.05 to 1 part by mass, with respect to 100 parts by mass of the monovinyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, these colorants can be used alone or in combination of two or more kinds. The amount of the colorant is preferably in the range from 1 to 10 parts by mass with respect to 100 parts by mass of the monovinyl monomer.

The colored resin particles used in the present invention contain a monoester compound A represented by the following formula (1) and a monoester compound B represented by the following formula (2) as the softening agents, and a content of the monoester compound A is in the range from 95 to 99% by mass, and a content of the monoester compound B is in the range from 1 to 5% by mass:

$$R^1—COO—R^2 \qquad \text{Formula (1):}$$

wherein, $R^1$ is a linear alkyl group having 17 to 23 carbons; $R^2$ is a linear alkyl group having 16 to 22 carbons; and a sum of the carbons of $R^1$ and $R^2$ is 39;

$$R^3—COO—R^4 \qquad \text{Formula (2):}$$

wherein, $R^3$ is a linear alkyl group having 15 to 21 carbons; $R^4$ is a linear alkyl group having 16 to 22 carbons; and a sum of the carbons of $R^3$ and $R^4$ is 35 to 37.

All of $R^1$ to $R^4$ may be the same group, a part of them may be the same group, or all of them may be different groups from one another.

In the case when $R^1$ to $R^4$ are greater than the above-mentioned ranges, the fixability of the toner decreases. On the other hand, in the case when $R^1$ to $R^4$ are smaller than the above-mentioned ranges, the heat-resistant shelf stability of the toner decreases.

In the monoester compound A represented in the formula (1), the difference between the carbon number in the raw material aliphatic acid (i.e., a carbon number obtained by adding 1 to the carbon number of $R^1$) and the carbon number in the raw material alcohol (i.e., the carbon number of $R^2$) is preferably from 0 to 6, more preferably from 2 to 6, and further preferably from 4 to 6. Furthermore, in the monoester compound B represented in the formula (2), the difference between the carbon number in the raw material aliphatic acid (i.e., a carbon number obtained by adding 1 to the carbon number of $R^3$) and the carbon number in the raw material alcohol (i.e., the carbon number of $R^4$) is preferably from 0 to 6, more preferably from 2 to 6, and further preferably from 4 to 6.

Specific examples of the monoester compound A represented by the above-mentioned formula (1) include behenyl stearate ($C_{17}H_{35}$—COO—$C_{22}H_{45}$), eicosyl eicosanoate ($C_{19}H_{39}$—COO—$C_{20}H_{41}$), stearyl behenate ($C_{21}H_{43}$—COO—$C_{18}H_{37}$) and hexadecyl lignocerate ($C_{23}H_{47}$—COO—$C_{16}H_{33}$) and the like. Among these monoester compounds, behenyl stearate and stearyl behenate are more preferable as the monoester compound A.

Specific examples of the monoester compound B represented by the above-mentioned formula (2) include eicosyl palmitate ($C_{15}H_{31}$—COO—$C_{20}H_{41}$), stearyl stearate ($C_{17}H_{35}$—COO—$C_{18}H_{37}$), hexadecyl eicosanoate ($C_{19}H_{39}$—COO—$C_{16}H_{33}$), behenyl palmitate ($C_{15}H_{31}$—COO—$C_{22}H_{45}$), eicosyl stearate ($C_{17}H_{35}$—COO—$C_{20}H_{41}$), stearyl eicosanoate ($C_{19}H_{39}$—COO—$C_{18}H_{37}$), hexadecyl behenate ($C_{21}H_{43}$—COO—$C_{16}H_{33}$) and the like. Among these monoester compounds, behenyl palmitate and eicosyl palmitate are more preferable as the monoester compound B.

In the softening agents, when the content of the monoester compound A is too greater than 99 mass %, the low-temperature fixability may decrease, whereas when the content of the monoester compound B is too greater than 5 mass %, the shelf stability and hot offset resistance may decrease.

It is more preferable that the softening agents are contained so that the monoester compound A is contained at a ratio of from 95.5 to 98.5 mass % and the monoester compound B is contained at a ratio of from 1.5 to 4.5 mass %, respectively.

The softening agents generally have a hydroxyl value of preferably 10 mgKOH/g or less, more preferably 6 mgKOH/g or less, further preferably 3 mgKOH/g or less. If the hydroxyl value is greater than 10 mgKOH/g, the shelf stability may decrease. The hydroxyl value of the softening agents is a value measured with reference to JIS K 0070, which is a standard method for analyzing fats and oils enacted by Japanese Industrial Standards Committee (JISC).

The softening agents have an acid value of preferably 1.0 mgKOH/g or less, more preferably 0.6 mgKOH/g or less, and further preferably 0.3 mgKOH/g or less. If the acid value is greater than 1.0 mgKOH/g, the shelf stability may decrease. The acid value of the softening agents is a value measured with reference to JIS K 0070, which is a standard method for analyzing fats and oils enacted by Japanese Industrial Standards Committee (JISC).

It is more preferable that the above-mentioned softening agents satisfy both of the above-mentioned conditions for the acid value and hydroxyl value.

A content of the softening agents is generally in the range from 10 to 30 parts by mass with respect to 100 parts by mass of the colored resin particle. If two or more kinds of the softening agents are used, the total content of the softening agents is generally in the range from 10 to 30 parts by mass with respect to 100 parts by mass of the colored resin particle. If the content of the softening agents is less than 10 parts by mass, the content is too low, so that low-temperature fixability may decrease. On the other hand, if the content of the softening agents exceeds 30 parts by mass, the content is too high, so that shelf stability may decrease.

The content of the softening agents is preferably in the range from 10 to 25 parts by mass, more preferably from 12 to 22 parts by mass, even more preferably from 15 to 20 parts by mass, with respect to 100 parts by mass of the colored resin particle.

It is preferable that the softening agents have a melting point of from 60 to 75° C. If the melting point of the softening agents is lower than 60° C., the toner may be poor in heat-resistant shelf stability. Furthermore, in the case when the melting point of the softening agents is higher than 75° C., the low-temperature fixability may decrease.

The melting point of the softening agents is more preferably from 63 to 72° C., further preferably from 65 to 70° C.

The melting point of the softening agents can be obtained by, for example, conducting a measurement by using a differential scanning calorimeter (trade name: RDC-220 manufactured by Seiko Instruments) or the like in a specific temperature range under a condition in which the temperature raises at 100° C./min, and deeming the top of the peak of the obtained DSC curve as a melting point (TmD).

Examples of the method for producing the monoester compounds A and B that are used for the above-mentioned softening agents include synthesis by oxidation reaction, synthesis from a carboxylic acid and a derivative thereof, ester group introducing reaction as typified by Michael addition reaction, a method using dehydration condensation reaction from a carboxylic acid compound and an alcohol compound, reaction from an acid halide and an alcohol compound, an ester exchange reaction. A catalyst can be appropriately used for the production of these monoester compounds. As the catalyst, preferred is a general acidic or alkaline catalyst used for an esterification reaction, such as zinc acetate and a titanium compound. After the esterification reaction, a desired product may be purified by recrystallization or distillation.

The typical example of the method for producing the monoester compounds A and B is as follows. The method for producing the monoester compounds A and B used in the present invention is not limited to the following typical example.

First, alcohol and carboxylic acid being starting materials are added to a reactor. A molar ratio of the alcohol and carboxylic acid is appropriately adjusted in accordance with the chemical structure of a target softening agent. For example, in the case of a monoester compound, alcohol and carboxylic acid are mixed so that a molar ratio of the alcohol and carboxylic acid is 1:1. In consideration of reactivity in a dehydration condensation reaction or the like, one of the alcohol and carboxylic acid may be added in slightly higher ratio than the above-mentioned ratio.

Next, thus obtained mixture is appropriately heated to perform a dehydration condensation reaction. To the esterified crude product obtained by the dehydration condensation reaction, a basic aqueous solution and an organic solvent (as needed) are added, and unreacted alcohol and carboxylic acid are deprotonated to separate water phase. Then, by appropriately performing washing with water, distilling of solvent and filtration, desired monoester compounds A and B can be obtained.

As one of other additives, a charge control agent having positively charging ability or negatively charging ability can be used to improve the charging ability of the toner.

The charge control agent is not particularly limited as long as it is generally used as a charge control agent for a toner. Among the charge control agents, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid salt group-containing copolymers, carboxylic acid group-containing copolymers and carboxylic acid salt group-containing copolymers which are preferably used as charge control resins.

In the present invention, it is desirable that the amount of the charge control agent to be used is generally in the range from 0.01 to 10 parts by mass, preferably from 0.03 to 8 parts by mass, with respect to 100 parts by mass of the monovinyl monomer. If the added amount of the charge control agent is less than 0.01 part by mass, fog may occur. On the other hand, if the added amount of the charge control agent exceeds 10 parts by mass, printing soiling may occur.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition comprising at least a polymerizable monomer, a colorant and softening agents is dispersed in an aqueous medium containing a dispersion stabilizer, and a polymerization initiator is added therein. Then, the droplets of the polymerizable monomer composition are formed. The method for forming droplets is not particularly limited. The droplets are formed by means of a device capable of strong agitation such as an in-line type emulsifying and dispersing machine (product name: MILDER; manufactured by Pacific Machinery & Engineering Co., Ltd.), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxydiethylacetate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the toner to be obtained; moreover, environmental stability can be excellent.

(A-3) Polymerization Process

After the droplets are formed as described in the above (A-2), thus obtained aqueous dispersion medium is heated to polymerize. Thereby, an aqueous dispersion of colored resin particles is formed.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particle may be used as a polymerized toner obtained by adding an external additive. It is preferable that the colored resin particle is so-called core-shell type (or "capsule type") colored resin particle which is obtained by using the colored resin particle as a core layer and forming a shell layer, a composition of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium to which the colored resin particles are dispersed followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide), 2,2'-azobis(2-methyl-N-(1,1-bis(hydroxymethyl)2-hydroxyethyl)propionamide), and 2,2'-azobis(N-(2-carboxyethyl)-2-methylpropionamidine), and hydrate thereof. These polymerization initiators can be used alone or in combination of two or more kinds. The amount of the polymerization initiator is preferably in the range from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In addition, a stripping treatment step for the aqueous dispersion of the colored resin particles may be provided before the series of the operations of washing, filtration, dehydration and drying.

The temperature of the aqueous dispersion during the stripping treatment is preferably from 60 to 95° C. If the temperature is too low, a sufficient stripping effect cannot be obtained, and the dispersion stabilizer, polymerizable monomer and the like may remain in the toner. If the temperature is too high, the water in the aqueous dispersion is vaporized excessively, and thus the following treatments may become difficult.

It is preferable to use an inert gas such as argon gas or nitrogen gas for the stripping treatment. The flow amount of the inert gas is preferably from 0.2 to 1.0 $m^3$/(hr·kg). If the flow amount is too small, a sufficient stripping effect cannot be obtained, and the dispersion stabilizer, polymerizable monomer and the like may remain in the toner. If the flow amount is too much, the water in the aqueous dispersion vaporizes excessively, and thus the following treatments may become difficult.

The time for the stripping treatment is preferably from 1 to 24 hours.

In the washing method, if the inorganic compound is used as the dispersion stabilizer, it is preferable that acid or alkali is added to the aqueous dispersion of colored resin particles; thereby, the dispersion stabilizer is dissolved in water and removed. If colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the following processes are performed.

First, a binder resin, a colorant, softening agents and other additives such as a charge control agent, etc., which are added if required, are mixed by means of a mixer such as a ball mill, a V type mixer, FM Mixer (product name), a high-speed dissolver, or an internal mixer. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the softening agents and other additives such as the charge control agent, etc., which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably in the range from 4 to 12 μm, more preferably from 5 to 10 μm. If the volume average particle diameter (Dv) of the colored resin particles is less than 4 μm, the flowability of the toner may lower, the transferability may deteriorate, and the image density may decrease. If the volume average particle diameter (Dv) of the colored resin particles exceeds 12 μm, the resolution of images may decrease.

As for the colored resin particles, a ratio (particle size distribution (Dv/Dn)) of the volume average particle diameter (Dv) and the number average particle diameter (Dn) is preferably in the range from 1.0 to 1.3, more preferably from 1.0 to 1.2. If "Dv/Dn" exceeds 1.3, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles of the present invention is preferably in the range from 0.96 to 1.00, more preferably from 0.97 to 1.00, even more preferably from 0.98 to 1.00, from the viewpoint of image reproducibility.

If the average circularity of the colored resin particles is less than 0.96, the reproducibility of thin lines may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

3. Method for Producing Toner of the Present Invention

In the present invention, the colored resin particles are mixed and agitated together with an external additive; thus, the external additive is attached on the surface of the colored resin particles to form a one-component toner (developer).

The one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include agitators capable of mixing and agitating, such as FM Mixer (product name; manufactured by NIPPON COKE & ENGINEERING CO., LTD.), SUPER MIXER (product name; manufactured by KAWATA Manufacturing Co., Ltd.), Q MIXER (product name; manufactured by NIPPON COKE & ENGINEERING CO., LTD.), Mechanofusion system (product name; manufactured by Hosokawa Micron Corporation) and MECHANOMILL (product name; manufactured by Okada Seiko Co., Ltd.). The external additive can be added to the colored resin particles by means of the above agitators.

Examples of the external additive include: inorganic particles comprising silica, titanium oxide, aluminum oxide, zinc oxide, tin oxide, calcium carbonate, calcium phosphate and/or cerium oxide; and organic particles comprising polymethyl methacrylate resin, silicone resin and/or melamine resin. Among them, inorganic particles are preferable. Among the inorganic particles, silica and/or titanium oxide is preferable, and particles comprising silica are more preferable.

These external additives are used alone, or in combination of two or more kinds. In particular, it is preferable to use two or more kinds of silica having a different particle diameter in a combination.

In the present invention, it is desirable that the amount of the external additive to be used is generally in the range from 0.05 to 6 parts by mass, preferably from 0.2 to 5 parts by mass, with respect to 100 parts by mass of the colored resin particles. If the added amount of the external additive is less than 0.05 part by mass, the toner after transfer may be remained. If the added amount of the external additive exceeds 6 parts by mass, fog may occur.

4. Toner of the Present Invention

The toner of the present invention obtained by undergoing the above-mentioned steps is a toner that is excellent in balance of heat-resistant shelf stability and low-temperature fixability, and is also excellent in hot offset resistance.

As an index of the heat-resistant shelf stability, for example, a heat-resistance temperature determined by the following method is exemplified.

A predetermined amount of the toner is put into a container, the container is sealed, and the container is left under a condition of a predetermined temperature. After a predetermined time has passed, the toner is transferred from the container onto a sieve, and the sieve is set on a powder characteristic tester (product name: POWDER TESTER PT-R; manufactured by Hosokawa Micron Corporation) or the like. The sieve was vibrated for a predetermined time under a predetermined condition of amplitude, the mass of the toner remained on the sieve was weighed, and the thus-measured toner was referred to as an aggregated toner mass. The maximum temperature at which the aggregated toner mass becomes a predetermined threshold value or less is determined as the heat-resistant temperature of the toner.

As an index of the low-temperature fixability, for example, a minimum fixing temperature determined by the following method is exemplified.

A fixing rate of the toner at a predetermined temperature is measured by using a predetermined printer. The fixing rate is calculated from a ratio of image densities before and after an operation of removing a predetermined tape from a black solid area that has been printed on a test paper by the printer. In particular, if the image density before removing the tape is referred to as ID (before) and the image density after removing the tape is referred to as ID (after), the fixing rate can be calculated from the following formula. The image density is measured by means of a reflection image densitometer (product name: RD918; manufactured by Macbeth Co.)

$$\text{Fixing rate (\%)}=(\text{ID (after)}/\text{ID (before)})\times 100$$

In this fixing test, the fixing temperature at which the fixing rate becomes a predetermined threshold value or more is deemed as the minimum fixing temperature of the toner.

The heat-resistance temperature is preferably 55° C. or more. If the heat-resistance temperature is lower than 55° C., blocking easily occurs in the case when the toner is exposed to high heat, and it may become possible that the quality after transportation cannot be ensured. Furthermore, even if the heat-resistance temperature is high and the heat-resistant shelf stability is excellent, in the case when the minimum fixing temperature is too high, it is not preferable in view of environments since much energy is required for fixing in an image forming device.

The softening temperature "Ts" of the toner of the present invention in a flow tester is preferably in the range from 55 to 70° C. If the softening temperature "Ts" of the toner in the flow tester is less than 55° C., the shelf stability may decrease. On the other hand, if the softening temperature "Ts" exceeds 70° C., the low-temperature fixability may decrease (minimum fixing temperature may increase).

The softening temperature "Ts" of the toner of the present invention in the flow tester is more preferably in the range from 56 to 67° C., further preferably from 57 to 65° C. The softening temperature "Ts" can be controlled by the composition of a polymerizable monomer, the amount of a polymerization initiator and the amount of a molecular weight modifier.

The flow starting temperature "Tfb" of the toner of the present invention in a flow tester is preferably in the range from 80 to 115° C. If the flow starting temperature "Tfb" of the toner in the flow tester is less than 80° C., the hot offset resistance may decrease (hot offset temperature may decrease). On the other hand, if the flow starting temperature "Tfb" exceeds 115° C., the low-temperature fixability may decrease.

The flow starting temperature "Tfb" of the toner of the present invention in a flow tester is more preferably from 85 to 110° C., further preferably from 90 to 105° C. The flow starting temperature "Tfb" can be controlled by the composition of a polymerizable monomer (in particular, the amount of a crosslinkable monomer), the amount of a polymerization initiator and the amount of a molecular weight modifier.

The melting temperature "Tm" of the toner of the present invention by a ½ method in a flow tester is preferably from 100 to 145° C. If the melting temperature "Tm" of the toner by a ½ method in a flow tester is lower than 100° C., the hot offset resistance may decrease. On the other hand, when the melting temperature "Tm" exceeds 145° C., the low-temperature fixability may decrease.

The melting temperature "Tm" of the toner of the present invention by a ½ method in a flow tester is more preferably from 120 to 140° C., further preferably from 127 to 138° C. The melting temperature "Tm" can be controlled by the added amount of the softening agents, the added amount of the crosslinkable polymerizable monomer, and the like.

The glass transition temperature of the toner of the present invention is preferably in the range from 44 to 60° C. If the glass transition temperature is less than 44° C., the shelf stability may decrease. On the other hand, if the glass transition temperature exceeds 60° C., the low-temperature fixability may decrease (minimum fixing temperature may increase).

The glass transition temperature of the toner of the present invention is more preferably in the range from 46 to 58° C., further preferably from 47 to 54° C. The glass transition temperature can be controlled by the composition of a polymerizable monomer, the amount of a polymerization initiator and the amount of a molecular weight modifier.

The softening temperature "Ts", flow starting temperature "Tfb" and melting temperature "Tm" by a ½ method of the toner in the flow tester can be calculated from the melt viscosity measured by means of the flow tester. In particular, the melt viscosity is measured by means of a flow tester (product name: CFT-500C; manufactured by SHIMADZU CORPORATION) under the conditions of a predetermined starting temperature, a heating rate, a preheating time and shear stress. Then, the softening temperature "Ts", flow starting temperature "Tfb" and melting temperature "Tm" by a ½ method of the toner can be calculated from thus obtained melt viscosity.

The glass transition temperature of the toner can be measured with reference to ASTM D3418-97. More specifically, a sample is heated at a heating rate of 10° C./minute by means of Differential Scanning calorimetry (product name: DSC6220; manufactured by SII Nanotechnology), and the glass transition temperature can be measured by a DSC curve obtained through the above heating process.

The number average molecular weight (Mn) of the toner is preferably from 5,000 to 20,000, more preferably from 7,000 to 15,000, and further preferably from 8,000 to 10,000. If the number average molecular weight of the toner is too large, the low-temperature fixability may decrease, whereas, conversely, if the number average molecular weight is too small, the heat-resistant shelf stability may decrease.

The weight average molecular weight (Mw) of the toner is preferably from 100,000 to 300,000, more preferably from 150,000 to 260,000, and further preferably from 200,000 to 230,000. If the weight average molecular weight of the toner is too large, the low-temperature fixability may decrease, whereas, conversely, if the weight average molecular weight is too small, the heat-resistant shelf stability may decrease.

The molecular weight distribution (Mw/Mn) of the toner is preferably from 10 to 40, more preferably from 15 to 35, and further preferably from 17 to 23. If the molecular weight distribution of the toner is too large, the low-temperature fixability and shelf stability may decrease, whereas, conversely, if the molecular weight distribution is too small, the hot offset resistance may decrease.

The number average molecular weight (Mn), weight average molecular weight (Mw) and molecular weight distribution (Mw/Mn) of the toner can be obtained by polystyrene conversion measured by, for example, gel permeation chromatography (GPC) using tetrahydrofuran (THF).

EXAMPLES

Hereinafter, the present invention will be described further in detail with reference to examples and comparative examples. However, the scope of the present invention may not be limited to the following examples. Herein, "part(s)" and "%" are based on mass if not particularly mentioned.

Test methods used in the examples and the comparative examples are as follows.

1. Synthesis of Monoester Compound

The carboxylic acid used for the synthesis of a monoester compound was obtained by recrystallizing a commercially available reagent having a purity of from 95 to 98% by hot ethanol/water to set the purity to 100% in advance.

Similarly, the alcohol used for the synthesis of a monoester compound was obtained by recrystallizing a commercially available reagent having a purity of from 95 to 98% by hot ethanol/water or acetone/water to set the purity to 100% in advance.

Synthesis Example 1

To a reaction container equipped with a thermometer, a nitrogen introduction tube, a stirrer, a Dean-Stark trap and a Dimroth cooling tube were added 100 parts behenyl alcohol and 79.8 parts stearic acid (a 1.05 mol equivalent amount with respect to the behenyl alcohol), and a reaction was conducted under a nitrogen flow at 220° C. for 15 hours under an ordinary pressure, while the water generated by the reaction was distilled off, whereby an esterified crude product was obtained.

20 parts toluene and 25 parts isopropanol were added to this esterified crude product, and 190 parts 10% aqueous potassium hydroxide solution in an amount corresponding to a 1.5 equivalent amount of the acid value of the esterified crude product was added, and the mixture was agitated at 70° C. for 30 minutes. The product was left to stand for 30 minutes, and the aqueous layer part was removed to complete the deacidifation step. Then, 20 parts ion exchanged water was put therein, and the mixture was agitated at 70° C. for 30 minutes and left to stand for 30 minutes to remove the aqueous layer part. The washing with water was repeated four times until the pH of the removed aqueous layer became neutral. The solvent of the ester layer was removed under the condition of 180° C. and reduced pressure of 1 kPa, and filteration was conducted to give 952.3 g of behenyl stearate 1 as a desired final product. The yield with respect to the esterified crude product subjected to the deacidification treatment was 95.2%.

Synthesis Example 2

An esterified crude product was obtained by using similar reaction container and raw materials to those of the above-mentioned Synthesis Example 1, and by conducting a reaction under a nitrogen flow at 220° C. for 5 hours at an ordinary pressure, while the water generated by the reaction was distilled off.

Subsequently, a deacidification step and the following steps were conducted in similar manners to those of the above-mentioned Synthesis Example 1, whereby behenyl stearate 2 was synthesized.

Synthesis Example 3

An esterified crude product was obtained by using a similar reaction container to that of the above-mentioned Synthesis Example 1, by adding eicosyl alcohol, and eicosanoic acid in a 1.05 molar equivalent amount with respect to the amount of the eicosyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby eicosyl eicosanoate was synthesized.

Synthesis Example 4

An esterified crude product was obtained by using a similar reaction container to that of the above-mentioned Synthesis Example 1, by adding stearyl alcohol, and behenic acid in a 1.05 molar equivalent amount with respect to the amount of the stearyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby stearyl behenate was synthesized.

Synthesis Example 5

An esterified crude product was obtained by using a similar reaction container to that of the above-mentioned Synthesis Example 1, by adding behenyl alcohol, and palmitic acid in a 1.05 molar equivalent amount with respect to the amount of the behenyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby behenyl palmitate was synthesized.

Synthesis Example 6

An esterified crude product was obtained by using a similar reaction container to that of the above-mentioned Synthesis Example 1, by adding behenyl alcohol, and myristic acid in a 1.05 molar equivalent amount with respect to the amount of the behenyl alcohol, by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby behenyl myristate was synthesized.

Synthesis Example 7

An esterified crude product was obtained by using a similar reaction container to that of the above-mentioned Synthesis Example 1, by adding stearyl alcohol, and stearic acid in a 1.05 molar equivalent amount with respect to the amount of the stearyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby stearyl stearate was synthesized.

Synthesis Example 8

An esterified crude product was obtained by using a similar reaction container to that of the above-mentioned Synthesis Example 1, by adding stearyl alcohol, and palmitic acid in a 1.05 molar equivalent amount with respect to the amount of the stearyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby stearyl palmitate was synthesized.

Synthesis Example 9

An esterified crude product was obtained by using a similar reaction container to that of the above-mentioned Synthesis Example 1, by adding behenyl alcohol, and eicosanoic acid in a 1.05 molar equivalent amount with respect to the amount of the behenyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby behenyl eicosanoate was synthesized.

Synthesis Example 10

An esterified crude product was obtained by using a similar reaction container to that of the above-mentioned Synthesis Example 1, by adding tetracosyl alcohol, and palmitic acid in a 1.05 molar equivalent amount with respect to the amount of the tetracosyl alcohol, and by conducting a reaction under a nitrogen flow at 220° C. for 15 hours at an ordinary pressure, while the water generated by the reaction was distilled off.

Subsequently, a deacidification step and the following steps were conducted in similar manners to those of the above-mentioned Synthesis Example 1, whereby tetracosyl palmitate was synthesized.

2. Production of Softening Agents

Production Example 1

Softening agents A were produced by mixing behenyl stearate 1 of the above-mentioned Synthesis Example 1 and the behenyl palmitate of the above-mentioned Synthesis Example 5 at a ratio of (behenyl stearate 1):(behenyl palmitate)=98.0 mass %: 2.0 mass %.

Production Example 2 to Production Example 8

Softening agents B to H were produced in a similar manner to that of Production Example 1, except that the kinds and mixing ratio of the monoester compounds were changed as shown in Table 1 in Production Example 1.

3. Properties of Toner Raw Materials (1) Melting Point of Softening Agents 6 to 8 mg of a sample of softening agents was weighed and put into a sample holder, and the sample was subjected to a measurement by using a differential scanning calorimeter (trade name: RDC-220 manufactured by Seiko Instruments) under a condition in which the temperature raises at 100° C./rain from −200° C. to 1,000° C., whereby a DSC curve was obtained. The top of the peak of the obtained DSC curve was deemed as the melting point (TmD).

(2) Acid Value and Hydroxyl Value of Softening Agents

The acid values and hydroxyl values of softening agents A to H were measured with reference to JIS K 0070, which is a standard method for analyzing fats and oils enacted by Japanese Industrial Standards Committee (JISC).

The results of the measurements and evaluations on softening agents A to softening agents H are shown in Table 1 together with the content ratios of the respective monoester compounds. With respect to softening agents A to softening agents D, monoester compounds 1 and 2 in the following Table 1 respectively correspond to monoester compounds A and B in the present invention.

TABLE 1

| | Softening agents A | Softening agents B | Softening agents C | Softening agents D | Softening agents E | Softening agents F | Softening agents G | Softening agents H |
|---|---|---|---|---|---|---|---|---|
| Synthesis number | Synthesis Example 1 | Synthesis Example 3 | Synthesis Example 4 | Synthesis Example 1 | Synthesis Example 1 | Synthesis Example 7 | Synthesis Example 9 | Synthesis Example 10 |
| Monoester compound 1 | Behenyl stearate 1 | Eicosyl eicosanoate | Stearyl behenate | Behenyl stearate 1 | Behenyl stearate 1 | Stearyl stearate | Behenyl eicosanoate | Tetracosyl palmitate |
| Carbon number of $R^1$ at the side of the aliphatic acid | 17 | 19 | 21 | 17 | 17 | 17 | 19 | 15 |
| Carbon number of $R^2$ at the side of the alcohol | 22 | 20 | 18 | 22 | 22 | 18 | 22 | 24 |
| Sum of the carbons of $R^1$ and $R^2$ | 39 | 39 | 39 | 39 | 39 | 35 | 41 | 39 |
| Mixing ratio (%) | 98.0 | 98.0 | 98.0 | 96.0 | 90.0 | 98.0 | 98.0 | 98.0 |
| Synthesis number | Synthesis Example 5 | Synthesis Example 5 | Synthesis Example 5 | Synthesis Example 5 | Synthesis Example 6 | Synthesis Example 8 | Synthesis Example 1 | Synthesis Example 5 |
| Monoester compound 2 | Behenyl palmitate | Behenyl palmitate | Behenyl palmitate | Behenyl palmitate | Behenyl myristate | Stearyl palmitate | Behenyl stearate 1 | Behenyl palmitate |
| Carbon number of $R^3$ at the side of the aliphatic acid | 15 | 15 | 15 | 15 | 13 | 15 | 17 | 15 |
| Carbon number of $R^4$ at the side of the alcohol | 22 | 22 | 22 | 22 | 22 | 18 | 22 | 22 |
| Sum of the carbons of $R^3$ and $R^4$ | 37 | 37 | 37 | 37 | 35 | 33 | 39 | 37 |
| Mixing ratio (%) | 2.0 | 2.0 | 2.0 | 4.0 | 10.0 | 2.0 | 2.0 | 2.0 |
| Melting point of softening agents (° C.) | 70 | 66 | 73 | 70 | 63 | 60 | 75 | 72 |
| Acid value of softening agents (mgKOH/g) | 0.1 | 0.1 | 0.1 | 0.1 | 0.1 | 0.1 | 0.1 | 0.1 |
| Hydroxyl value of softening agents (mgKOH/g) | 0.7 | 0.8 | 0.8 | 0.7 | 1.5 | 1.0 | 0.8 | 1.2 |

4. Production of Toner for Developing Electrostatic Images

Example 1

73 parts styrene and 27 parts n-butyl acrylate as monovinyl monomers, 7 parts carbon black (product name: #25B; manufactured by Mitsubishi Chemical Corporation) as a black colorant, 0.75 part divinylbenzene as a crosslinkable polymerizable monomer, 0.38 part styrene/acrylic resin (product name: FCA-592P manufactured by Fujikura Kasei Co., Ltd.) as a charge control agent, 1 part tetraethylthiuramdisulfide as a molecular weight modifier and 0.25 part polymethacrylic acid ester macromonomer (product name: AA6; manufactured by Toagosei Co., Ltd., Tg=94° C.) as a macromonomer were agitated and mixed in a general stirrer, and subjected to homogenized dispersion by means of a media type dispersing machine. Thereto, 20 parts softening agents A (melting point: 70° C.) produced in Production Example 1 was added, mixed and dissolved to give a polymerizable monomer composition. The preparation of the polymerizable monomer composition was conducted at room temperature from the beginning to end.

Separately, in an agitating chamber, an aqueous solution of 4.1 parts sodium hydroxide dissolved in 50 parts ion-exchanged water was gradually added to an aqueous solution of 7.4 parts magnesium chloride dissolved in 250 parts ion-exchanged water at room temperature while agitating to prepare a magnesium hydroxide colloid dispersion (3.0 parts magnesium hydroxide).

The above polymerizable monomer composition was charged into the above-obtained magnesium hydroxide colloid dispersion and the mixture was agitated at room temperature until the droplets were stable. Then, 5 parts t-butyl peroxy-2-ethylhexanoate (product name: PERBUTYL 0; manufactured by NOF Corporation) as a polymerization initiator was added therein followed by being subjected to a high shear agitation at 15,000 rpm by means of an in-line type emulsifying and dispersing machine (product name: MILDER; manufactured by Pacific Machinery & Engineering Co., Ltd.). Thus, droplets of the polymerizable monomer composition were formed.

The above magnesium hydroxide colloid dispersion containing the droplets of the polymerizable monomer composition dispersed therein was put into a reactor equipped with agitation blades, and the temperature was raised to 89° C. so as to keep the temperature constant, and a polymerization reaction was conducted. Then, when the polymerization conversion reached 98%, the temperature in the system was cooled to 75° C., and at 15 minutes after the temperature reached 75° C., 3 parts methyl methacrylate as a polymerizable monomer for shell, and 0.36 part 2,2'-azobis[2-methyl-N-(1,1-bis(hydroxymethyl)2-hydroxyethyl)propionamide]tetrahydrate (trade name: VA086, manufactured by Wako Pure Chemical Industries) dissolved in 10 parts ion exchanged water were added thereto. The polymerization was continued for further 3 hours, and the reaction was stopped, whereby an aqueous dispersion of colored resin particles having a pH of 9.5 was obtained.

Then, the aqueous dispersion of the colored resin particles was set to 80° C., a stripping treatment was conducted at a nitrogen gas flow amount of 0.6 $m^3$/(hr·kg) for 5 hours, and the aqueous dispersion was cooled to 25° C. Then, the pH of the system was adjusted to 6.5 or less with sulfuric acid, the obtained aqueous dispersion was subjected to acid washing under agitation at 25° C., the water was separated by filtration, and a slurry was formed again by newly adding 500 parts of ion exchanged water. Then, dehydration and water washing were repeatedly conducted several times, and the solid content was separated by filtration, put into a drier and dried at a temperature of 40° C. for 12 hours.

To 100 parts of the colored resin particles obtained as above were added 0.7 part hydrophobidized silica microparticles having a number average primary particle diameter of 7 nm and 1 part of hydrophobidized silica microparticles having a number average primary particle diameter of 50 nm, and the particles were mixed by using a high-speed stirrer (trade name: FM Mixer, manufactured by Nippon Coke & Engineering Co., Ltd.), whereby the toner for developing electrostatic images of Example 1 was produced. The test results are shown in Table 2.

Example 2 to Example 6 and Comparative Example 1 to Comparative Example 4

The toners for developing electrostatic images of Example 2 to Example 6 and Comparative Example 1 to Comparative Example 4 were produced in a similar manner to that of Example 1, except that the kinds or added amount of the softening agents was changed in Example 1 as shown in Table 2. The properties of the obtained respective toners for developing electrostatic images are shown in Table 2.

5. Evaluations of Properties of Colored Resin Particles and Toner

The properties were examined for the toners of the above Example 1 to Example 6 and Comparative Example 1 to Comparative Example 4, and for the colored resin particles used in the toners. The details are as follows.

(1) Volume Average Particle Diameter Dv and Particle Size Distribution Dv/Dn of Colored Resin Particles The volume average particle diameter Dv, number average particle diameter Dn and particle size distribution Dv/Dn of the colored resin particles were measured by means of a particle diameter measuring device (product name: MULTISIZER; manufactured by Beckman Coulter, Inc.). The measurement by MULTISIZER was conducted under the conditions of an aperture diameter of 100 μm, a dispersion medium: ISOTON II (trade name), a concentration of 10%, and a number of the measured particles of 100,000.

Specifically, 0.2 g of a sample of colored resin particles was put into a beaker, and an aqueous solution of an alkylbenzenesulfonic acid (trade name: DRIWEL, manufactured by Fujifilm Corporation) as a dispersing agent was added thereto. 2 mL of a dispersion medium was further added thereto, to thereby wet the colored resin particles, 10 mL of a dispersion medium was added, and the mixture was dispersed in an ultrasonic dispersing device for 1 minute and then subjected to a measurement by the above-mentioned particle diameter measuring device.

(2) Softening Temperature (Ts), Flow Starting Temperature (Tfb) and Melting Temperature (Tm) by a ½ Method of Colored Resin Particles 1.0 to 1.3 g of the colored resin particles were put into an elevated flow tester (product name: CFT-500C; manufactured by SHIMADZU CORPORATION), and the softening temperature (Ts), flow starting temperature (Tfb) and melting temperature (Tm) by a ½ method were measured under the following measurement conditions.

Starting temperature=40° C.
Heating rate=3° C./minute
Preheating time=5 minutes
Cylinder pressure=10 kg·f/$cm^2$
Dice diameter=0.5 mm
Dice length=1.0 mm
Shear stress=$2.451\times10^5$ Pa (3) Glass Transition Temperature (Tg) of Colored Resin Particles The glass transition temperature (Tg) of the colored resin particles was measured by the following method.

About 10 mg of the colored resin particles obtained by drying was precisely weighed, and using a differential scanning calorimeter (trade name: DSC6220 manufactured by SII Nanotechnology), and according to ASTM D 3418-97, the precisely-weighed measurement sample was put into an aluminum pan, and the glass transition temperature of the colored resin particles was measured between a range of a measurement temperature of from 0 to 150° C. under a condition of a heating rate of 10° C./minute by using an empty aluminum pan as a reference.

(4) Number Average Molecular Weight (Mn), Weight Average Molecular Weight (Mw) and Molecular Weight Distribution (Mw/Mn) of Colored Resin Particles The number average molecular weight (Mn), weight average molecular weight (Mw) and molecular weight distribution (Mw/Mn) of the colored resin particles were obtained by polystyrene conversion measured by gel permeation chromatography (GPC). Specifically, the measurement was conducted by using the following methods.

(a) Preparation of Sample

About 10 mg of the colored resin particles was dissolved in 5 mL of a tetrahydrofuran solvent, and the solution was left at 250° C. for 16 hours and filtered through a 0.45 μm membrane filter to give a sample.

(b) Measurement Conditions

Temperature: 350° C., solvent: tetrahydrofuran, flow rate: 1.0 mL/min, concentration: 0.2 wt %, sample injection amount: 100 μL (c) Column GPC TSK gel Multipore HXL-M manufactured by Tosoh Corporation was used (30 cm×2 pieces). The measurement was conducted under the condition that a primary correlation formula: Log (Mw)−elution time at a molecular weight Mw of between 1,000 and 300,000 is 0.98 or more.

(5) Evaluation of Toner Characteristics (a) Minimum Fixing Temperature and Hot Offset Temperature A fixing test was conducted by using a commercially available printer of the non-magnetic one-component developing method (printing rate: 20 sheets/minute), which was refurbished so that the temperature of a fixing roller of the printer was changed. In the fixing test, the temperature of the fixing roller in the refurbished printer was changed by 5° C., and then the fixing rate of the toner was measured at each temperature.

The fixing rate was calculated from a ratio of image densities before and after an operation of removing a tape from a black solid area that has been printed on a test paper by the refurbished printer. In particular, if the image density before removing the tape is referred to as ID (before) and the image density after removing the tape is referred to as ID (after), the fixing rate can be calculated from the following formula:

$$\text{Fixing rate (\%)}=(\text{ID (after)}/\text{ID (before)})\times 100$$

The tape removing operation means a series of operations including: attaching an adhesive tape (product name: SCOTCH MENDING TAPE 810-3-18; manufactured by Sumitomo 3M Limited) to a measuring part (a black solid area) of a test paper to be adhered by pressure at a constant pressure; and removing the adhesive tape in a direction along the paper at a constant rate. The image density was measured by means of a reflection image densitometer (product name: RD918; manufactured by Macbeth Co.)

In this fix test, the minimum fixing roll temperature at which the fixing rate was 80% or more was deemed as the minimum fixing temperature of the toner.

Then, the temperature was further raised, and the temperatures until hot offset occurred were measured.

A hot offset test was conducted by using a refurbished printer that was similar to that in the measurement of the minimum fixing temperature. In the hot offset test, a print pattern having print areas of a black solid (print concentration: 100%) and a white solid (print concentration: 0%) was printed while the temperature of the fixing roll part was changed from 150° C. to 230° C. by 5° C., and whether or not print fouling was observed in the print area of the white solid (print concentration: 0%) and the presence or absence of occurrence of fusion bonding of the toner on the fixing roll (hot offset phenomenon) were observed by visual observation at each temperature.

Whether or not print fouling was observed on the printing area of the white solid (print concentration: 0%) and the presence or absence of occurrence of fusion bonding of the toner on the fixing roll (hot offset phenomenon) were observed by visual observation at each temperature.

In this hot offset test, the minimum fixing roller temperature at which print fouling or fusion bonding of the toner on the fixing roll occurred was deemed as a hot offset occurrence temperature. The hot offset occurrence temperature of the toner is preferably more than 210° C. in view of heat resistance.

If a hot offset phenomenon does not occur even at the timepoint when the temperature of the fixing roll is 230° C., the hot offset occurrence temperature is represented as "230<" in Table 2.

(b) Heat-Resistant Shelf Stability 10 g of the toner was put in a sealable container, and the container was sealed and set to a predetermined temperature water bath that had been set to a predetermined temperature and removed from the constant temperature water bath after 8 hours had passed. The toner was transferred from the removed container onto a 42-mesh sieve so that the toner was not vibrated as possible, and the sieve was set on a powder characteristic tester (product name: POWDER TESTER PT-R; manufactured by Hosokawa Micron Corporation). The condition of amplitude of the sieve was set to 1.0 mm, the sieve was vibrated for 30 seconds, and the mass of the toner remained on the sieve was measured and referred to as an aggregated toner mass.

The maximum temperature at which the mass of the aggregated toner became 0.5 g or less was referred to as a heat-resistance temperature and used as an indicator of heat-resistant shelf stability.

The results of the measurements and evaluations of the toners for developing electrostatic images of Example 1 to Example 6, and Comparative Example 1 to Comparative Example 4 are shown in Table 2.

TABLE 2

| | | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|
| Softening agents | Type | Softening agents A | Softening agents B | Softening agents C | Softening agents D | Softening agents A | Softening agents A | Softening agents E | Softening agents F | Softening agents G | Softening agents H |
| | Added amount (part) | 20 | 20 | 20 | 20 | 12 | 25 | 20 | 20 | 20 | 20 |
| Properties of colored resin par- | Volume average particle diameter Dv (μm) | 7.8 | 7.8 | 7.9 | 7.9 | 7.8 | 7.8 | 8.0 | 7.8 | 7.8 | 7.9 |
| | Particle size distribution | 1.11 | 1.12 | 1.12 | 1.11 | 1.11 | 1.11 | 1.12 | 1.13 | 1.15 | 1.15 |

TABLE 2-continued

| | | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|
| ticles | Dv/Dn | | | | | | | | | | |
| | Softening temperature Ts (° C.) | 58 | 59 | 60 | 57 | 63 | 57 | 56 | 56 | 64 | 58 |
| | Flow starting temperature Tfb (° C.) | 91 | 91 | 94 | 90 | 97 | 90 | 88 | 89 | 101 | 89 |
| | Melting temperature Tm by a 1/2 method (° C.) | 124 | 121 | 126 | 122 | 132 | 120 | 118 | 120 | 132 | 115 |
| | Glass transition temperature Tg (° C.) | 49 | 48 | 50 | 49 | 51 | 51 | 45 | 46 | 52 | 48 |
| | Number average molecular weight Mn | 8600 | 8600 | 8400 | 8700 | 9000 | 9000 | 8800 | 9500 | 8600 | 8200 |
| | Weight average molecular weight Mw | 227900 | 225680 | 220000 | 221000 | 235570 | 235570 | 230080 | 240000 | 219000 | 220000 |
| | Molecular weight distribution Mw/Mn | 27 | 26 | 26 | 25 | 26 | 26 | 26 | 25 | 25 | 27 |
| Evaluation of toner | Minimum fixing temperature (° C.) | 125 | 130 | 130 | 125 | 135 | 120 | 125 | 120 | 140 | 135 |
| | Hot offset temperature (° C.) | 230< | 230< | 230< | 230< | 230< | 230< | 180 | 200 | 230< | 190 |
| | Heat-resistance temperature (° C.) | 58 | 58 | 59 | 57 | 60 | 56 | 54 | 53 | 61 | 54 |

6. Summary of Toner Evaluation

Hereinafter, the evaluation results of the toner will be reviewed with reference to Tables 1 and 2.

First, the toner of Comparative Example 1 will be reviewed. From Tables 1 and 2, the toner of Comparative Example 1 contains 20 parts of softening agents E, which contain behenyl stearate 1 (90 mass %) and behenyl myristate (10 mass %). From Table 1, softening agents E have a melting point of 63° C., an acid value of 0.1 mgKOH/g, and a hydroxyl value of 1.5 mgKOH/g.

From Table 2, the toner of Comparative Example 1 has a minimum fixing temperature of 125° C. Therefore, the toner of Comparative Example 1 has no problem with at least low-temperature fixability.

However, the toner of Comparative Example 1 has a low hot offset temperature of 180° C. and a low heat-resistance temperature of 54° C. In particular, the hot offset temperature of the toner of Comparative Example 1 is the lowest among those of the toners evaluated at this time.

Accordingly, it can be understood that the toner of Comparative Example 1, which uses softening agents E containing less than 95 mass % of behenyl stearate 1 (monoester compound A) and containing behenyl myristate wherein the carbon number of $R^3$ at the side of the aliphatic acid is lower than 15, is poor in hot offset resistance and also poor in heat-resistant shelf stability.

Subsequently, the toner of Comparative Example 2 will be considered. From Table 1 and Table 2, the toner of Comparative Example 2 contains 20 parts of softening agents F, which contain stearyl stearate (98 mass %) and stearyl palmitate (2 mass %). From Table 1, softening agents F have a melting point of 60° C., an acid value of 0.1 mgKOH/g and a hydroxyl value of 1.0 mgKOH/g.

From Table 2, the toner of Comparative Example 2 has a minimum fixing temperature of 120° C. Therefore, the toner of Comparative Example 2 has no problem with at least low-temperature fixability.

However, the toner of Comparative Example 2 has a low hot offset temperature of 200° C. and a low heat-resistance temperature of 53° C. In particular, the heat-resistance temperature of Comparative Example 2 is the lowest among those of the toner evaluated at this time.

It can be understood that the toner of Comparative Example 2, which uses softening agents F containing 95 mass % or more of stearyl stearate in which the sum of the carbon number of $R^1$ at the side of the aliphatic acid and the carbon number of $R^2$ at the side of the alcohol is lower than 39, and containing 5 mass % or less of stearyl palmitate in which the sum of the carbon number of $R^3$ at the side of the aliphatic acid and the carbon number of $R^4$ at the side of the alcohol is lower than 35, is poor in hot offset resistance and also poor in heat-resistant shelf stability.

Subsequently, the toner of Comparative Example 3 will be considered. From Table 1 and Table 2, the toner of Comparative Example 3 contains 20 parts of softening agents G, which contain behenyl eicosanoate (98 mass %) and behenyl stearate 1 (2 mass %). From Table 1, softening agents G have a melting point of 75° C., an acid value of 0.1 mgKOH/g, and a hydroxyl value of 0.8 mgKOH/g.

From Table 2, the toner of Comparative Example 3 has a hot offset temperature of more than 230° C. and a heat-resistance temperature of 61° C. Accordingly, the toner of Comparative Example 3 has no problem with at least hot offset resistance and heat-resistant shelf stability.

However, the toner of Comparative Example 3 has a high minimum fixing temperature of 140° C. The minimum fixing temperature of Comparative Example 3 is the highest among those of the toners evaluated at this time.

Accordingly, it can be understood that the toner of Comparative Example 3 using softening agents G, which contain 95 mass % or more of behenyl eicosanoate in which the sum of the carbon number of $R^1$ at the side of the aliphatic acid and the carbon number of $R^2$ at the side of the alcohol is more than 39, and contain 5 mass % or less of behenyl stearate 1 in which the sum of the carbon number of $R^3$ at the side of the aliphatic acid and the carbon number of $R^4$ at the side of the alcohol is more than 37, is poor in low-temperature fixability.

Subsequently, the toner of Comparative Example 4 will be considered. From Table 1 and Table 2, the toner of Comparative Example 4 contains 20 parts of softening agents H, which contain tetracosyl palmitate (98 mass %) and behenyl palmitate (2 mass %). From Table 1, the softening agents H have a melting point of 72° C., an acid value of 0.1 mgKOH/g and a hydroxyl value of 1.2 mgKOH/g.

From Table 2, the toner of Comparative Example 4 has a minimum fixing temperature of 135° C. Accordingly, the toner of Comparative Example 4 has no problem with at least low-temperature fixability.

However, the toner of Comparative Example 4 has a low hot offset temperature of 190° C. and a low heat-resistance temperature of 54° C.

Accordingly, it can be understood that the toner of Comparative Example 4 using softening agents H, which contain tetracosyl palmitate in which the carbon number of $R^2$ at the side of the alcohol is more than 22, is poor in hot offset resistance and heat-resistant shelf stability.

In contrast, from Table 1 and Table 2, the toners of Example 1 to Example 6 each contain 12 to 25 parts of any one of softening agents A to D. Softening agents A to D each contain from 96 to 98 mass % of either one of behenyl stearate 1, eicosyl eicosanoate or stearyl behenate, and 2 to 4 mass % of behenyl palmitate, respectively. From Table 1, softening agents A to D have a melting point of from 66 to 73° C., an acid value of 0.1 mgKOH/g in all cases, and a hydroxyl value of from 0.7 to 0.8 mgKOH/g.

From Table 2, the toners of Example 1 to Example 6 have a low minimum fixing temperature of 135° C. or less, a hot offset temperature of more than 230° C. in all cases, and a high heat-resistance temperature of 56° C. or more.

Therefore, it can be understood that the toners of the present invention, which contain, as softening agents, the monoester compound A having the structure of the above-mentioned formula (1) at a ratio of from 95 to 99 mass %, and the monoester compound B having the structure of the above-mentioned formula (2) at a ratio of from 1 to 5 mass %, respectively, and contain the softening agents of from 10 to 30 parts by mass with respect to 100 parts by mass of the binder resin, are excellent in balance of heat-resistant shelf stability and low-temperature fixability, and are also excellent in hot offset resistance.

Example 1 (added amount: 20 parts), Example 5 (added amount: 12 parts) and Example 6 (added amount: 25 parts), which are different only in the added amount of the softening agents, are compared below.

From Table 2, the toner of Example 5 is slightly superior in heat-resistant shelf stability but is slightly inferior in low-temperature fixability to the toner of Example 1. Furthermore, the toner of Example 6 is slightly superior in low-temperature fixability but is slightly inferior in heat-resistant shelf stability to the toner of Example 1.

It is presumed from the above-mentioned results that the low-temperature fixability becomes slightly more excellent but the heat-resistant shelf stability becomes slightly poorer as the added amount of the softening agents increases, whereas, conversely, the heat-resistant shelf stability becomes slightly more excellent but the low-temperature fixability becomes slightly poorer as the added amount of the softening agents decreases.

The invention claimed is:

1. A toner for developing electrostatic images, comprising an external additive and colored resin particles containing a binder resin, a colorant and softening agents, wherein the colored resin particles contain a monoester compound A represented by the following formula (1) and a monoester compound B represented by the following formula (2) as the softening agents, and a content of the monoester compound A is in the range from 95 to 99% by mass, and a content of the monoester compound B is in the range from 1 to 5% by mass, on an assumption that a sum of the contents of the monoester compound A and B is 100% by mass, and wherein a content of the softening agents is in the range from 10 to 30 parts by mass, with respect to 100 parts by mass of the binder resin:

$$R^1—COO—R^2 \quad \text{Formula (1)}$$

wherein, $R^1$ is a linear alkyl group having 17 to 23 carbons; $R^2$ is a linear alkyl group having 16 to 22 carbons; and a sum of the carbons of $R^1$ and $R^2$ is 39;

$$R^3—COO—R^4 \quad \text{Formula (2)}$$

wherein, $R^3$ is a linear alkyl group having 15 to 21 carbons; $R^4$ is a linear alkyl group having 16 to 22 carbons; and a sum of the carbons of $R^3$ and $R^4$ is 35 to 37.

2. The toner for developing electrostatic images according to claim 1, wherein the softening agents have a melting point of 60 to 75° C.

3. The toner for developing electrostatic images according to claim 1, wherein the softening agents have an acid value of 1.0 mgKOH/g or less and a hydroxyl value of 10 mgKOH/g or less.

4. The toner for developing electrostatic images according to claim 2, wherein the softening agents have an acid value of 1.0 mgKOH/g or less and a hydroxyl value of 10 mgKOH/g or less.

5. The toner for developing electrostatic images according to claim 1, wherein a ratio of particle size distribution (Dv/Dn) of volume average particle diameter (Dv) and number average particle diameter (Dn) for the colored resin particles is 1.0 to 1.3.

* * * * *